US005330870A

United States Patent [19]

Tanaka et al.

[11] Patent Number: 5,330,870

[45] Date of Patent: Jul. 19, 1994

[54] DEVELOPER COMPOSITION FOR ELECTROPHOTOGRAPHY FOR FLASH FUSING

[75] Inventors: Shingo Tanaka, Kainan; Koji Nishibuchi, Wakayama; Koji Shimokusa, Wakayama; Tetsuya Ueno, Wakayama, all of Japan

[73] Assignee: Kao Corporation, Tokyo, Japan

[21] Appl. No.: 937,429

[22] Filed: Aug. 31, 1992

[30] Foreign Application Priority Data

Sep. 7, 1991 [JP] Japan ..... 3-255763

[51] Int. Cl.[5] ..... G03G 9/00

[52] U.S. Cl. ..... 430/109; 430/107; 430/124

[58] Field of Search ..... 430/109, 107, 124

[56] References Cited

U.S. PATENT DOCUMENTS 2,297,691 10/1942 Carlson ..... 430/56
2,357,809 9/1944 Carlson ..... 430/56
4,478,923 10/1984 DeRoot et al. ..... 430/109

FOREIGN PATENT DOCUMENTS 56-30139 3/1981 Japan .
2270964 11/1987 Japan .
63-75755 4/1988 Japan .

*Primary Examiner*—Steve Rosasco
*Attorney, Agent, or Firm*—Birch, Stewart, Kolasch & Birch

[57] ABSTRACT

An electrophotographic developer composition for flash fusing containing at least a binder resin based on a polyester resin and a colorant, the polyester resin being formed between an acid component, not less than 80 mol % of the acid component being phthalic acid series dicarboxylic acid and an alcohol component, not less than 80 mol % of the alcohol component being bisphenol A alkylene oxide adduct, the polyester resin having an acid value of not more than 10.0 KOH mg/g, a softening temperature of not less than 95.0° C. and not more than 125.0° C. as determined using a flow tester of the "koka-shiki" type and a glass transition temperature of not less than 50.0° C. and not more than 80.0° C. as determined by DSC, whereby substantially no odor is produced upon flash fusing.

8 Claims, No Drawings

DEVELOPER COMPOSITION FOR ELECTROPHOTOGRAPHY FOR FLASH FUSING

BACKGROUND OF THE INVENTION

1. Field of the Invention

The present invention relates to a developer composition for electrostatic image development in electrophotography, electrostatic recording, electrostatic printing and other fields, and more particularly to a developer composition suitable for flash fusing.

2. Discussion of the Related Art

As described in U.S. Pat. Nos. 2,297,691 and 2,357,809 and other publications, the prior art electrophotography comprises forming an electric latent image by evenly charging a photoconductive insulating layer and subsequently exposing the layer to eliminate the charge in the exposed portion and visualizing the formed image by adhering colored charged fine powder known as a toner to the latent image (a developing process), transferring the obtained visible image to an image-receiving sheet such as a transfer paper (a transfer process), and permanently fixing the transferred image by heating, pressure application or another appropriate means of fixing (a fixing process).

As stated above, a toner must meet the requirements not only in the development process but also in the transfer process and fixing process.

With respect to the fixing process described above, the most common among currently available methods is so-called heat roller fixing, wherein heat and pressure are applied simultaneously, but flash fusing, a fixing method using light, is used for the following reasons:

1) Because it is non-contact fixing, there is no fear of image staining, i.e. offset phenomenon, or deterioration of resolution, such as with image expansion upon passage through the upper and lower rollers, as seen in contact fixing;
2) Because it is unnecessary to make a specific design for preventing image staining as seen in contact fixing, for example, addition of wax as a release agent to toner, coating with silicone oil as a release agent to a fixing roller, etc. the degree of freedom in designing the toner and fusing apparatus is high;
3) Fixing is possible irrespective of the material and thickness of recording paper.

However, while having such advantages, flash fusing is subject to various limitations as to the developer binder used due to the inherent property thereof. Specifically, when the toner used for heat roller fixing is used as such, for instance, a problem arises that high energy is required to soften and fuse the toner because the molecular weight of the binder is so high that it cannot be easily softened and fused; in flash fusing, the toner image formed on the recording paper must be irradiated with flash light using an electrical discharge tube such as a xenon flash lamp, thereby instantaneously raising temperature to soften and fuse the toner and adhere it to the recording paper.

Also, in flash fusing, because the toner is instantaneously heated to a high temperature, a large amount of decomposed product is formed on the toner surface, which in turn contaminates the working environment. In recent years, with the increasing demand for more rapid printing, the amount of decomposed product formed per unit time has increased, thus posing a problem of influence on the working environment. For this reason, a developer for flash fusing with little decomposition product is now desired.

To meet this requirement, there has been proposed a developer for flash fusing based on a polyester resin containing terephthalic acid and/or isophthalic acid as a main acid component and neopentyl glycol as a main alcohol component (Japanese Patent Laid-Open No. 75755/1988). However, this invention is not satisfactory with respect to prevention of influence on the working environment, since the molecular weight of the resin is in the oligomer range so that residual monomer of neopentyl glycol is present, which is potentially odorous upon fixing, though the thermal decomposition resistance of the toner has improved. Also, in the polyester resins based on neopentyl glycol, since the ester group concentration is high and hence a large amount of water is adsorbed in a high-temperature, high-humidity environment, that evaporation of the water contained therein or hydrolysis is induced by the high temperature in the flash fusing, which results in increased fumes attributable to sublimation of the low molecular components.

On the other hand, another developer for flash fusing containing bisphenol A/epichlorohydrin type epoxy resin as the main resin components has been proposed, wherein the amount of the low molecular substances formed upon flash fusing is very low (Japanese Patent Laid-Open No. 30139/1981). However, such a resin undergoes void formation due to its low fusing viscosity, though it is easily and rapidly fusible and fixable on recording paper, even when the intensity of the flash light used is very weak. Here, the term void means the porosity of the fused image, wherein porous fusing of the fused image occurs due to the low fusing viscosity of the resin.

As a method for improving the porosity of the fused image, the use of a terminal amide-modified epoxy resin, which has resulted from the reaction of a low molecular amide compound with an epoxy compound at the molecular terminal thereof, as a binder resin has been proposed (Japanese Patent Laid-Open No. 270964/1987). However, this method is unsatisfactory in that the higher fatty acid used, which has 10 or more carbon atoms, tends to be present as a residue, which can be odorous upon exposure to high temperature, though void has improved. Also, another problem arises that attention should be given to the use of epoxy compounds, which have a highly reactive epoxy ring at the terminal thereof, because some of them show positive response in mutagenicity test.

SUMMARY OF THE INVENTION

An object of the present invention, developed under the above background, is to provide an electrophotographic developer composition for flash fusing which produces only a small amount of decomposed product and hence causes no contamination of the working environment, and which emits little fume and undergoes no void upon fixing in copying machines and printers equipped with a flash fusing apparatus.

With the aim of solving the problems described above, the present inventors have made investigations and thus developed the present invention.

Accordingly, the present invention essentially relates to:

(1) an electrophotographic developer composition for flash fusing containing at least a binder resin based on a polyester resin and a colorant, wherein polyester resin is formed between an acid component, not less than 80 mol % of the component being phthalic acid series dicarboxylic acid and an alcohol component, not less than 80 mol % of the component being bisphenol A alkylene oxide adduct, said polyester resin having an acid value of not more than 10.0 KOH mg/g, a softening point of not less than 95.0° C. and not more than 125.0° C., as determined using a flow tester of the "kokashiki" type, and a glass transition temperature of not less than 50.0° C. and not more than 80.0° C., as determined by DSC, and substantially no odor is produced upon flash fusing;

(2) the electrophotographic developer composition for flash fusing as described in (1), wherein the polyester resin has a number-average molecular weight of not less than 3,000 and not more than 6,000 and a weight-average molecular weight of not less than 10,000 and not more than 500,000; and (3) the electrophotographic developer composition for flash fusing as described in (1) or (2), wherein the polyester resin adsorbs water in a ratio of not more than 0.7%, as determined by Karl Fischer's method after being kept standing at a temperature of 35° C. and a humidity of 85% RH for 24 hours.

The electrophotographic developer composition of the present invention contains at least a binder resin based on the polyester resin and a colorant, wherein the polyester resin comprises an acid component, not less than 80 mol % of the component, preferably not less than 90 mol %, and more preferably 100%, being phthalic acid series dicarboxylic acid. Phthalic acid series dicarboxylic acid contents of less than 80 mol % are undesirable because they lead to a relative increase in the amount of potentially odorous monomer used.

Examples of phthalic acid series dicarboxylic acids include terephthalic acid, isophthalic acid, orthophthalic acid, anhydrides thereof and lower alkyl esters thereof having 1 to 4 carbon atoms, with preference given to terephthalic acid and isophthalic acid. These may be used singly or in combination.

Other acid components can be used in combination with the compounds described above, as long as their use poses no problem of odor formation upon flash fusing. Examples thereof include maleic acid, fumaric acid, citraconic acid, itaconic acid, glutaconic acid, cyclohexanedicarboxylic acid, succinic acid, adipic acid, sebacic acid, azelaic acid, and malonic acid. Further, they include alkylsuccinic acids or alkenylsuccinic acids such as n-butylsuccinic acid, n-butenylsuccinic acid, isobutylsuccinic acid, isobutenylsuccinic acid, n-octylsuccinic acid, n-octenylsuccinic acid, n-dodecylsuccinic acid, n-dodecenylsuccinic acid, isododecylsuccinic acid and isododecenylsuccinic acid; anhydrides thereof; lower alkyl esters thereof and other divalent carboxylic acids.

However, the use of these other acid components in excess is undesirable for use in the binder resin for flash fusing because it poses a problem of odor due to their sublimation property and weak heat resistance. The amount of use thereof is, therefore, not more than 20 mol %, preferably not more than 10 mol % of the total acid component content.

In addition to dicarboxylic acids, tricarboxylic or higher carboxylic acids can also be used as other acid components. Examples of tricarboxylic or higher carboxylic acids include 1,2,4-benzenetricarboxylic acid, 1,3,5-benzenetricarboxylic acid and other polycarboxylic acids, anhydrides thereof and lower alkyl esters thereof having 1 to 4 carbon atoms. Of these monomers, 1,2,4-benzenetricarboxylic acid is preferably used because it produces no odor. The use of an alkyl ester having 4 or more carbon atoms is undesirable because it poses a problem of odor.

However, the use of these tricarboxylic or higher carboxylic acid components in excess is undesirable for use in the binder resin for flash fusing because these components which serve as crosslinking agents produce high molecular weight, thereby excessively increasing their melt viscosity. The amount used is, therefore, not more than 20 mol %, preferably not more than 10 mol %, and more preferably not more than 5 mol % of the total acid component content.

The electrophotographic developer composition of the present invention contains at least a binder resin based on polyester resin and a colorant, wherein the polyester resin comprises an alcohol component, not less than 80 mol % of the component, preferably not less than 90 mol %, and more preferably not less than 95 mol %, being bisphenol A alkylene oxide adduct. Bisphenol A alkylene oxide adduct contents of less than 80 mol % are undesirable because they lead to relative increase in the amount of potentially odorous monomer used.

In the present invention, the bisphenol A alkylene oxide adduct includes a compound represented by the following formula:

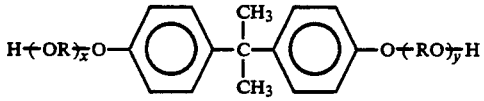

wherein R represents an ethylene group or propylene group; x and y are each an integer of 1 or more, with proviso that an average value of x+y is 2 to 7. Examples thereof include polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane, polyoxypropylene(6)-2,2-bis(4-hydroxyphenyl)propane and the like. Among them, preference is given to polyoxypropylene(2.2)-2,2-bis(4-hydroxyphenyl)propane, polyoxyethylene(2.2)-2,2-bis(4-hydroxyphenyl)propane, polyoxyethylene(2.0)-2,2-bis(4-hydroxyphenyl)propane and the like. These may be used singly or in combination.

In the range, so as not to pose a problem of odor upon flash fusing, other alcohol components can be used together with the above-mentioned compounds. For instance, diols such as ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol and the like, or other dihydric alcohols such as bisphenol A, hydrogenated bisphenol A and the like may be further added.

Examples of the trihydric or higher polyhydric alcohol components include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and other trihydric or higher polyhydric alcohols.

However, since these alcohol components have weak heat resistance, when the amount of use is too excessive, it poses problems of odor, making it undesirable for use in a binder resin for flash fusing. Accordingly, the amount of use thereof is normally not more than 20 mol % of the total alcohol components, preferably not more than 10 mol %.

The developer composition of the present invention contains at least a binder resin based on a polyester resin and a colorant, wherein the polyester resin has an acid value of not more than 10.0 KOH mg/g, a softening point of not less than 95.0° C. and not more than 125.0° C., as determined using a flow tester of the "koka-shiki" type, and a glass transition temperature of not less than 50.0° C. and not more than 80.0° C., as determined by DSC.

When the acid value exceeds 10.0 KOH mg/g, the amount of water adsorbed in a high-temperature, high humidity atmosphere becomes large, thereby presumably inducing hydrolysis due to high temperature upon flash fusing, which in turn increases fumes comprising a mist of a low molecular weight component. With respect to the acid value, it is more preferable to be not more than 8 KOH mg/g, and still more preferable to be not more than 5 KOH mg/g. The acid value is measured by the method defined by JIS K0070.

With respect to the softening point as determined using a flow tester of the "koka-shiki" type, when it is less than 95.0° C., the obtained polymer has increased low molecular components due to the lowering of its average molecular weight, thereby making the blocking resistance of the toner poor. On the other hand, when it exceeds 125.0° C., the melt viscosity of the obtained polymer becomes large, thereby making the flash fusing capability poor. The softening point is preferably 100.0° C. to 120.0° C.

The softening point of the polyester resin for the present invention, as determined by using a flow tester of the "koka-shiki" type, is defined as follows:

The softening point is defined as the temperature corresponding to half the height of from the flow starting point to the flow end point measured using a flow tester of the "koka-shiki" type (CFT-500) available from Shimadzu Corporation when a 1 $cm^3$ sample is molten and flown out under conditions of a dice pore size of 1 mm, a pressure of 20 $kg/cm^2$ and a temperature elevation rate of 6° C./min.

With respect to the glass transition temperature as determined using DSC (differential scanning calorimeter), when it is less than 50.0° C., the blocking resistance of the toner is poor, and when it exceeds 80.0° C., the flash fusing capability is lowered. The glass transition temperature is preferably 55.0° to 70.0° C.

In the present invention, the glass transition temperature as determined using DSC is measured by the method defined by ASTM(D3418-75).

As a means for controlling the softening point as measured using a flow tester of the "koka-shiki" type to not less than 95.0° C. and not more than 125.0° C. and also the acid value of the polyester resin to not more than 10.0 KOH mg/g, it is desired that the ratio of the number of acid component functional groups and the number of alcohol component functional groups is 0.65:1 to 0.95:1 in the preparing stage for the polyester resin.

The developer composition of the present invention at least contains a binder resin based on a polyester resin and a colorant, wherein the polyester resin has a number-average molecular weight (Mn) of not less than 3,000 and not more than 6,000, and a weight-average molecular weight (Mw) of not less than 10,000 and not more than 500,000. The number-average molecular weight is preferably not less than 3,500 and not more than 5,500, and the weight-average molecular weight is preferably not less than 10,000 and not more than 250,000.

When the number-average molecular weight is less than 3,000 and the weight-average molecular weight is less than 10,000, the amount of the low molecular weight components becomes too large, thereby making the blocking resistance of the toner poor. On the other hand, the number-average molecular weight exceeds 6,000 and the weight-average molecular weight exceeds 500,000, the amount of the high molecular weight component becomes too large, thereby making the flash fusing capability poor.

In the present invention, the number-average molecular weight and weight-average molecular weight are determined by GPC, and their measurement conditions are as follows:

| | |
|---|---|
| GPC Apparatus: | HTACHI 665A-11 |
| Detector: | SHODEX RI SE-51 |
| Column: | SHODEX GPC (KF-806) + (KF-804) + (KF-802) |
| Solvent: | Tetrahydrofuran (THF) |
| Flow Rate: | 1.0 ml/min |

The developer composition of the present invention contains at least a binder resin based on a polyester resin and a colorant, wherein the polyester resin adsorbs water in a ratio of not more than 0.7%, preferably not more than 0.5% as determined by Karl Fischer's method after being kept standing at a temperature of 35° C. and a humidity of 85% RH for 24 hours. It is speculated that when the adsorbed water content exceeds 0.7%, hydrolysis due to high temperature upon flash fusing is induced, which results in increased fumes attributable to mist of low molecular components. Here, the amount of adsorbed water, as determined by the Karl Fischer's method, is measured in accordance with JIS K0068.

The polyester resin used in the present invention can be prepared by condensation polymerization at a temperature of 180° to 250° C. in an inert gas atmosphere. In this case, an esterification catalyst commonly used such as zinc oxide, stannous oxide, dibutyltin oxide and dibutyltin dilaurate may be used to accelerate the reaction. Alternatively, it may also be prepared under a reduced pressure for the same purpose.

In the present invention, although the polyester resin is used as a main component of the binder resin, the binder resin may further contain other resins such as a styrene or styrene-acrylate resin having a number-average molecular weight of not more than 11,000 in an amount of normally up to 30% by weight in the binder resin, preferably 20% by weight or so, to enhance the pulverizability for producing the toner, as long as their use poses no problem in odor upon flash fusing.

As the colorants to be used for the toner composition of the present invention, those conventionally known inorganic pigments such as carbon black, iron black and the like, colorful dyes and organic pigments can be used.

To the toner composition of the present invention, a charge control agent is added, if necessary. To the negative charge toner, one or more kind selected from all negative charge control agents, which have been conventionally known to be used for electrophotography, may be used. In addition, to the positive charge toner, one or more kind selected from all positive charge control agents, which have been conventionally known to be used for electrophotography, may be used. The negative charge control agents may be used in combination with the positive charge control agents. These control agents may be used in an amount of normally 0.1 to 8.0% by weight, preferably 0.2 to 5.0 by weight based on the binder resin.

To the developer composition of the present invention, hydrophobic silica may be added, if necessary, for the purpose of improving the fluidity, and the degree of the hydrophobic property of the silica used, determined by the methanol titration test, is not less than 80.

In addition, to use the developer composition of the present invention as a magnetic toner, a magnetic powder may be contained. As magnetic powders for such purposes, substances magnetized in a magnetic field are used, including powders of the ferromagnetic metals such as iron, cobalt and nickel, and alloys or compounds such as magnetite, hematite and ferrite. The content of such magnetic powders is 0.1 to 50% by weight based on the weight of the developer composition.

Further, the developer composition according to the present invention is used as a developer for forming an electric latent image by mixing it with carrier particles such as iron powder, glass beads, nickel powder and ferrite powder, if necessary.

The developer composition of the present invention is applicable for various developing methods. Examples of these methods include the magnetic brush development, the cascade development, the development using a conductive magnetic toner, the development using an insulative magnetic toner, the fur brush development, the powder cloud development, the impression development and the like.

The developer composition of the present invention produces little odor or fumes due to decomposition because it is based on a polyester resin which is excellent in fixing ability and because its main component is a substance which is hardly decomposable even under high-temperature conditions upon flash fusing. Also, because the softening point, the glass transition temperature and the molecular weight of the resin are in the range appropriate for flash fusing, fixing free of void formation is possible. In addition, even under high-temperature, high-humidity conditions, evaporation of the water contained or hydrolysis is not induced because the amount of water adsorbed is low, and only a small amount of fumes attributable to sublimation of low molecular components is emitted.

PREFERRED EMBODIMENTS

The present invention is hereinafter described in more detail by means of the following examples and comparative examples, but the invention is not to be interpreted as limitative by these examples.

(1) PRODUCTION EXAMPLES OF BINDER RESINS

Production Example 1 (binder resin 1)

5.0 mol of polyoxypropylene(2.2)-2,2-bis(4-hydroxyphenyl)propane, 5.0 mol of polyoxyethylene(2.2)-2,2-bis(4-hydroxyphenyl)propane, 4.6 mol of terephthalic acid, 4.6 mol of isophthalic acid and 5.0 g of dibutyltin oxide were placed in a four-necked glass flask, and a thermometer, a stainless steel stirring rod, a condenser and a nitrogen sparging tube were attached thereto. The reaction was carried out in a nitrogen stream in a mantle heater at 220° C. for 3 hours, subsequently at 240° C. for 3 hours and under a reduced pressure of 60 mmHg at 240° C. for 2 hours to complete the reaction.

The obtained resin was a light yellow solid, having an acid value of 2.1 KOH mg/g, a softening point of 110° C. as determined using the flow tester of "koka-shiki" type, a glass transition temperature of 66° C. as determined using DSC, and Mn and Mw as determined using GPC of, respectively, 4,200 and 14,000.

This resin is referred to as binder resin 1.

Production Examples 2 through 7 (binder resins 2 through 7)

Using the starting material of compositions shown in Table 1, the same procedure as in Preparation Example 1 was carried out to yield binder resins 2 through 7. Table 1 shows the acid value, the softening point as determined using the flow tester of "koka-shiki" type, the glass transition temperature and Mn and Mw of the obtained resins.

Production Example 8 (binder resin 8)

1865 g of polyoxypropylene (2.2)-2,2-bis(4-hydroxyphenyl)propane and 2.9 g of polyoxypropylene(6)sorbitol were placed in a 3-liter four-necked glass flask equipped with a thermometer, a stainless steel stirring rod, a condenser and a nitrogen sparging tube. This flask was supported on a GLAS-COL mantle heater. Through the nitrogen sparging tube, nitrogen gas was flown to make the atmosphere in the reactor inert while stirring the polyol blend. Next, the mantle heater was activated to heat the polyol blend to 50° C. While maintaining at this temperature, 628 g of fumaric acid and 1.25 g of hydroquinone were added to the reactor. Nitrogen gas flow rate was set at 2.5 on the indicator of SHO-RATE meter, produced by Brooks Rotometer Company. The reactants were heated at 210° C. for 5 hours. The water resulting from the esterifying reaction was removed upon its formation, and further the reactants were kept at 210° C. for 6.5 hours. The progress of the reaction was monitored by determining the acid value at one-hour intervals. When the end point was reached, i.e., when the acid value became about 20 KOH mg/g, the resin was cooled to room temperature. In the production of this resin, the ratio of hydroxyl groups to carboxyl groups was 1 to 1. The resin thus obtained was evaluated in the same manner as in Production Example 1. The results are shown in Table 1.

This resin is referred to as binder resin 8.

Production Example 9 (binder resin 9)

700 g of polyoxypropylene(2.2)-2,2-bis(4-hydroxyphenyl)propane and 97.2 g of terephthalic acid were placed in a 1-liter four-necked glass flask equipped with a thermometer, a stainless steel stirring rod, a condenser and a nitrogen sparging tube. Next, the flask was placed in a mantle heater. Through the nitrogen sparging tube, nitrogen gas was flown into the reactor, and while keeping the atmosphere in the reactor inert, the temperature was raised. After reacting at 200° C. in the presence of 0.05 g of dibutyltin oxide, 156 g of 1,2,4-benzenetricarboxylic anhydride was added, followed by further reaction.

The progress of the reaction was monitored on the basis of the softening point as determined the ring-and-ball method. When the softening point reached 120° C., the reaction was terminated and the reaction mixture was cooled to room temperature. The resin thus obtained was evaluated in the same manner as in Production Example 1. The results are shown in Table 1.

This resin was prepared as a developer composition for oil-free heat roller fixing, wherein trimellitic anhydride as a crosslinking agent was used in a ratio of 58 mol % of the acid component content to introduce a high density of a crosslinked structure.

This resin is referred to as binder resin 9.

Production Example 10 (binder resin 10)

490 g of polyoxypropylene(2.2)-2,2-bis(4-hydroxyphenyl)propane, 195 g of polyoxyethylene(2.0)-2,2-bis(4-hydroxyphenyl)propane, 188 g of terephthalic acid, 26.8 g of n-dodecyl succinic anhydride and 0.8 g of diisopropyl orthotitanate as an esterification catalyst were placed in a 1-liter four-necked glass flask equipped with a thermometer, a stainless steel stirring rod, a condenser and a nitrogen sparging tube. Next, the flask was placed in a mantle heater. Through the nitrogen sparging tube, nitrogen gas was flown into the reactor, and while keeping the atmosphere in the reactor inert, the temperature was raised. After the reaction is carried out at a temperature kept at 230° C. for 5 hours while stirring, the acid value was measured and found to be 2.0 KOH mg/g.

Further, 78.8 g of trimellitic anhydride was added at a temperature of 200° C., and the reaction was carried out for about 4 hours. A further reaction was carried out for 2 hours under reduced pressure, and when the softening point as determined by the ring-and-ball method reached 115° C., the reaction was terminated. The obtained resin was evaluated in the same manner as in Production Example 1. The results are shown in Table 1.

This resin was prepared as a developer composition for high speed heat roller fixing having an excellent low temperature fixing ability, wherein trimellitic anhydride as a crosslinking agent was Used and a long chain alkyl group was introduced on the side chain of the molecular structure.

This resin is referred to as binder resin 10.

Production Example 11 (binder resin 11)

770 g of polyoxypropylene(2.2)-2,2-bis(4-hydroxyphenyl)propane, 720 g of polyoxyethylene(2.2)-2,2-bis(4-hydroxyphenyl)propane, 690 g of terephthalic acid, 120 g of tri 2-ethylhexyl 1,2,4-benzenetricarboxylic acid, and 2.4 g of dibutyltin oxide as an esterification catalyst were placed in a 2-liter four-necked glass flask, equipped with a thermometer, a stainless steel stirring rod, a condenser and a nitrogen sparging tube. Next, the flask was placed in a mantle heater. Through the nitrogen sparging tube, nitrogen gas was flown into the reactor, and while keeping the atmosphere in the reactor inert, the temperature was raised. After the reaction is carried out at a temperature kept at 210° C. under normal pressure for 8 hours while stirring, and a further reaction was carried out at 210° C. for 5 hours under reduced pressure. The obtained resin was evaluated in the same manner as in Production Example 1. The results are shown in Table 1.

This resin was prepared as a developer composition having an excellent chargeability, wherein tri-2-ethylhexyl ester of trimellitic acid as a crosslinking agent was used and the resulting developer composition has an acid value controlled to not more than 5 KOH mg/g.

This resin is referred to as binder resin 11.

The binder resins 5 through 11 are comparative binder resins.

TABLE 1

| Binder Resin | 1 | 2 | 3 | 4 | 5 | 6 | 7 | 8 | 9 | 10 | 11 |
|---|---|---|---|---|---|---|---|---|---|---|---|
| Acid Component (mol) | | | | | | | | | | | |
| Terephthalic Acid | 4.6 | 8.5 | 8.0 | 8.0 | 5.0 | 5.0 | 4.5 | | 0.585 | 1.132 | 4.15 |
| Isophthalic Acid | 4.6 | | | | 5.0 | 5.0 | 4.5 | | | | |
| Trimellitic Anhydride | | 0.7 | | | | | | | 0.812 | 0.410 | |
| Trimethyl Trimellitate | | | 1.5 | | | | 1.0 | | | | |
| Tri-2-ethylhexyl Trimellitate | | | | | | | | | | | 0.22 |
| Fumaric Acid | | | | | | | | 5.409 | | | |
| Adipic Acid | | | | 1.5 | | | | | | | |
| n-Dodecyl Succinic Anhydride | | | | | | | | | | 0.1 | |
| Alcohol Component (mol) | | | | | | | | | | | |
| BPA-PO (2.2) | 5.0 | 5.0 | 9.0 | 9.0 | 5.0 | 5.0 | 5.0 | 5.329 | 2.0 | 1.4 | 2.2 |
| BPA-PO (2.2) | 5.0 | 5.0 | | | 5.0 | 5.0 | | | | | 2.2 |
| BPA-PO (2.0) | | | | | | | | | | 0.617 | |
| Ethylene Glycol | | | 1.0 | | | | | | | | |
| Neopentyl Glycol | | | | | | | 5.0 | | | | |
| Glycerol | | | | 1.0 | | | | | | | |
| Sorbitol PO (6) | | | | | | | | 0.0055 | | | |
| Amount of Phthalic Acid Series Dicarboxylic Acid in Acid Compo. | 100 | 92.4 | 84.2 | 84.2 | 100 | 100 | 90 | 0 | 41.9 | 68.9 | 95 |
| Amount of BPA-AO Adduct in Alcohol Component (mol %) | 100 | 100 | 90 | 90 | 100 | 100 | 50 | 99.9 | 100 | 100 | 100 |
| Properties | | | | | | | | | | | |
| Acid Value (KOH mg/g) | 2.1 | 4.2 | 1.9 | 4.5 | 11.3 | 5.0 | 17.2 | 18.1 | 33 | 33 | 2.3 |
| Softening Point (°C.) | 110 | 115 | 120 | 110 | 110 | 130 | 120 | 100 | 135 | 115 | 103.0 |
| Glass Transition Temperature (°C.) | 66 | 68 | 65 | 64 | 68 | 75 | 66 | 61 | 58 | 61 | 61 |
| Mw | 14000 | 45000 | 250000 | 120000 | 18000 | 28000 | 130000 | 9000 | 450000 | 45000 | 12000 |
| Mn | 4200 | 5500 | 4800 | 4500 | 5000 | 7600 | 5000 | 4000 | 3200 | 5500 | 3600 |
| $H_2O$ % (KF Method) | 0.4 | 0.5 | 0.4 | 0.6 | 0.8 | 0.6 | 0.9 | 1.1 | 1.2 | 0.8 | 0.3 |

In Table 1, the following abbreviations are used:

BPA-PO(2.2): Polyoxypropylene(2.2)-2,2-bis(4-hydroxyphenyl)propane;

BPA-EO(2.2): Polyoxyethylene(2.2)-2,2-bis(4-hydroxyphenyl)propane;

BPA-EO(2.0): Polyoxyethylene(2.0)-2,2-bis(4-hydroxyphenyl)propane;

Sorbitol PO(6): 6 mol polypropylene oxide adduct of sorbitol;

BPA-AO Adduct: Alkylene oxide adduct of bisphenol A; and $H_2O$ %

| | |
|---|---|
| BPA-PO(2.2): | Polyoxypropylene(2.2)-2,2-bis(4-hydroxyphenyl)propane; |
| BPA-EO(2.2): | Polyoxyethylene(2.2)-2,2-bis(4-hydroxyphenyl)propane; |
| BPA-EO(2.0): | Polyoxyethylene(2.0)-2,2-bis(4-hydroxyphenyl)propane; |
| Sorbitol PO(6): | 6 mol polypropylene oxide adduct of sorbitol; |
| BPA-AO Adduct: | Alkylene oxide adduct of bisphenol A; and $H_2O$ % |
| (KF Method): | Amount of water adsorbed determined by the Karl Fischer's method after being kept for 24 hours under the conditions of a temperature of 35° C. and a humidity of 85% RH. |

(2) PRODUCTION EXAMPLES OF TONER

Example 1

Materials in the following composition were mixed using a Henschel mixer and then mixed in a molten state using a twin screw extruder and cooled, after which the mixture was subjected to ordinary pulverization and classification processes to prepare toner 1 having an average particle size of 11 μm.

| Composition: | |
|---|---|
| Binder resin 1 | 90 parts |
| Carbon black #44 (produced by Mitsubishi Chemical Industries Ltd.) | 7 parts |
| Positive charge control agent Bontron N-01 (produced by Orient Chemical Co., Ltd.) | 3 parts |

Examples 2 through 4

Toners 2 through 4 were prepared in the same manner as in Example 1 except that the binder resin 1 was replaced with the binder resins 2 through 4.

Comparative Examples 1 through 8

Comparative toners 1 through 7 were prepared in the same manner as in Example 1 except that the binder resin 1 was replaced with the binder resins 5 through 11, respectively.

Further, the toner provided with positive charge control was prepared by using a commercially available resin comprising styrene/2-ethylhexylacrylate (84/16), which is referred to as comparative toner 8. The softening point was 135° C.

(3) Evaluation of Toner Performance

A developer comprising 4 parts by weight of the toner described above and 96 parts by weight of the carrier TEFV 200/300 (iron powder, produced by Powdertech Co., Ltd.) was prepared, and an image was duplicated with this developer by the use of a commercially available laser printer using the flash fusing method. The fusing apparatus was set at charging voltages of 1700 V and 1800 V which were applied to the flash lamp using a condenser having a static capacity of 160 μF.

Evaluation of fixing ability:

The lowest fixing temperature for the toner is the temperature of the paper surface at which the fixing rate of the toner exceeds 70%. This fixing rate of the toner is determined by placing a load of 500 g on a sand-containing rubber eraser having a bottom area of 15 mm×7.5 mm which contacts the fixed toner image, placing the loaded eraser on a fixed toner image obtained in the fusing apparatus, moving the loaded eraser on the image backward and forward twice, measuring the optical reflective density of the eraser-treated image with a reflective densitometer manufactured by Macbeth Co., and then calculating the fixing rate from this density value and a density value before the eraser treatment using the following equation.

$$\text{Fixing rate (\%)} = \frac{\text{Image density after eraser treatment}}{\text{Image density before eraser treatment}} \times 100$$

Presence or absence of void:

Void resulting from porous fusing was macroscopically observed.

Presence or absence of fume:

Fume emitted from the toner image upon fixing was macroscopically observed.

Odor evaluation:

The odor produced upon heating the developer composition was evaluated as follows. A 10 g sample of the developer composition was heated on a 140° C. hot plate for 1 minute. Then, at a distance of 10 cm, the odor was smelled by 10 panelists. The evaluation criteria are as follows:

○: Not more than 2 panelists sensed the odor;

Δ: 3 to 5 panelists sensed the odor; and

×: Not less than 6 panelists sensed the odor.

In this evaluation, the level at which not more than 2 panelists sense the odor poses no problem, since actual printers are equipped with a deodorizing apparatus.

(4) EVALUATION RESULTS

The above-mentioned evaluation results are shown in Table 2.

TABLE 2

| | Fixing Rate (%) | | Presence of Void | Presence | Evaluation |
|---|---|---|---|---|---|
| | 1700V | 1800V | Formation | of Fume | of Odor |
| Toner | | | | | |
| 1 | 90 | 95 | No | No | ○ |
| 2 | 85 | 90 | No | No | ○ |
| 3 | 80 | 85 | No | No | ○ |
| 4 | 85 | 90 | No | No | ○ |
| Comparative Toner | | | | | |
| 1 | 90 | 95 | No | Yes | ○ |
| 2 | 50 | 60 | No | No | ○ |
| 3 | 85 | 90 | No | Yes | X |
| 4 | 95 | 95 | Yes | Yes | X |
| 5 | 45 | 50 | No | Yes | Δ |
| 6 | 80 | 85 | No | Yes | X |
| 7 | 90 | 95 | No | No | X |
| 8 | 50 | 55 | No | Yes | X |

As is evident from Table 2, with respect to the toners 1 through 4 according to the present invention, all of which were prepared with a resin wherein the softening point, glass transition temperature, molecular weight and monomer type were carefully selected to meet the requirements, they showed a good fixing rate, and no void or fume and good evaluation of odor upon flash fusing.

On the other hand, none of the comparative toners satisfied all of these requirements, as described below.

Comparative toner 1 emitted fume attributable to the high content of water adsorbed due to high acid value, though the fusing ability and odor evaluation were good.

Comparative toner 2 posed a problem of fusing ability due to a high softening point.

Comparative toner 3 emitted fume attributable to the high content of water adsorbed due to high acid value as in comparative toner 1, and had an odor originating from neopentyl glycol.

Comparative toner 4 produced void due to the low molecular weight, though the fusing ability was good, and it had an odor originating from fumaric acid.

Comparative toner 5 posed a problem in fusing ability due to too high softening point associated with introduction of a high density of crosslinked structure.

Comparative toner 6 emitted fume attributable to the high content of water adsorbed due to high acid value as in comparative toner 1, and had an odor originating from n-dodecyl succinic anhydride.

Comparative toner 7 had an odor originating from 2-ethylhexanol resulting from the ester exchanging reaction, though the fusing ability and void evaluation were good.

Comparative toner 8 was poor in fusing ability because it is for use in heat roller fusing apparatus, and it had a too strong odor of vinyl monomer to deserve evaluation.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrophotographic developer composition for flash fusing which comprises a binder resin comprising a polyester resin and a colorant, wherein said polyester resin is formed between an acid component, not less than 80 mol % of said acid component being a phthalic acid series dicarboxylic acid, and an alcohol component, not less than 80 mol % of said alcohol component being a bisphenol A alkylene oxide adduct, said polyester resin having an acid value of not more than 10.0 KOH mg/g, a softening temperature of not less than 95.0° C. and not more than 125.0° C., as determined using a flow tester of the "koka-shiki" type, and a glass transition temperature of not less than 50.0° C. and not more than 80.0° C., as determined by DSC, whereby substantially no odor is produced upon flash fusing.

2. The electrophotographic developer composition according to claim 1, wherein said polyester resin has a number-average molecular weight of not less than 3,000 and not more than 6,000 and a weight-average molecular weight of not less than 10,000 and not more than 500,000.

3. The electrophotographic developer composition according to claim 1, wherein said polyester resin adsorbs water in a ratio of not more than 0.7% as determined by Karl Fischer's method after being kept standing at a temperature of 35° C. and a humidity of 85% RH for 24 hours.

4. The electrophotographic developer composition according to claim 1, wherein said phthalic acid series dicarboxylic acid is selected from the group consisting of terephthalic acid, isophthalic acid, orthophthalic acid, anhydrides thereof and lower alkyl esters thereof having 1 to 4 carbon atoms.

5. The electrophotographic developer composition according to claim 1, wherein said bisphenol A alkylene oxide adduct is represented by the formula:

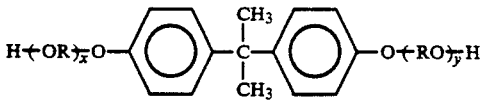

wherein R represents an ethylene group or propylene group; x and y are each an integer of 1 or more, with the proviso that an average value of x+y is 2 to 7.

6. The electrophotographic developer composition according to claim 5, wherein said bisphenol A alkylene oxide adduct is selected from at least one member of the group consisting of polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxyethylene(2.2)-2,2-bis(4-hydroxyphenyl)propane, polyoxypropylene(2.0)-polyoxyethylene(2.0)-2,2-bis(4-hydroxyphenyl)propane and polyoxypropylene(6)-2,2-bis(4-hydroxyphenyl)propane.

7. The electrophotographic developer composition according to claim 1, wherein said phthalic acid series dicarboxylic acid is selected from at least one member of the group consisting of terephthalic acid, isophthalic acid, an anhydride thereof and a lower alkyl ester thereof having 1 to 4 carbon atoms, and said bisphenol A alkylene oxide adduct is selected from the at least one member of group consisting of polyoxypropylene(2.2)-2,2-bis(4-hydroxyphenyl)propane, polyoxyethylene(2.2)-2,2-bis(4-hydroxyphenyl)propane and polyoxyethylene(2.0)-2,2-bis(4-hydroxyphenyl)propane.

8. An electrophotographic imaging method comprising:

forming an electrostatic latent image on the surface of a support member, developing said electrostatic latent image with an electrophotographic developer composition comprising a binder resin, which comprises a polyester resin, and a colorant, said polyester resin being formed between an acid component, not less than 80 mol % of said acid component being a phthalic acid series decarboxylic acid, and an alcohol component, not less than 80 mol % of the alcohol component being bisphenol A alkylene oxide adduct, said polyester resin having an acid value of not more than 10.0 KOH mg/g, a softening temperature of not less than 95° C. and not more than 125° C. as determined using a flow tester of the "koka-shiki" type and a glass transition temperature of not less than 50° C. and not more than 80° C. as determined by DSC, and flash fusing said developed electrostatic latent image, whereby substantially no odor is produced by said flash fusing.

* * * * *